US005150750A

United States Patent [19]

Lessi et al.

[11] Patent Number: 5,150,750

[45] Date of Patent: Sep. 29, 1992

[54] DEVICE FOR ACTIVATING AND MEASURING NONFLOWING PRODUCING WELLS

[75] Inventors: Jacques Lessi, Maule; Christian Wittrisch, Rueil-Malmaison, both of France

[73] Assignee: Institut Francais du Petrole, Rueil-Malmaison, France

[21] Appl. No.: 723,392

[22] Filed: Jun. 28, 1991

[30] Foreign Application Priority Data

Jun. 29, 1990 [FR] France ..... 90 08270

[51] Int. Cl.[5] ..... E21B 4/04

[52] U.S. Cl. ..... 166/66.4; 166/118; 73/151

[58] Field of Search ..... 166/65.1, 66, 385, 250, 166/53, 332; 175/48; 250/260, 266; 73/155

[56] References Cited

U.S. PATENT DOCUMENTS

| | | | |
|---|---|---|---|
| 4,166,215 | 8/1979 | Anderson | 250/260 |
| 4,574,193 | 5/1986 | Arnold et al. | 250/266 X |
| 4,690,214 | 9/1987 | Wittrisch | 166/65.1 X |
| 4,905,203 | 2/1990 | Sims et al. | 175/48 X |
| 4,928,758 | 5/1990 | Siegfried, II | 166/66 |
| 4,928,759 | 5/1990 | Siegfried, II et al. | 166/65.1 |
| 4,974,446 | 12/1990 | Vigneaux | 73/155 |
| 4,984,634 | 1/1991 | Pilla | 166/385 X |
| 5,018,574 | 5/1991 | Smith | 166/65.1 X |

*Primary Examiner*—Ramon S. Britts
*Assistant Examiner*—Frank S. Tsay
*Attorney, Agent, or Firm*—Antonelli, Terry, Stout & Kraus

[57] ABSTRACT

A device comprising a flow string of two parts separated by an assembly for pumping effluents and a side-entry sub lowered into an equipped well provided with a pipe perforated in the part thereof going through a producing zone. At least one assembly of measuring instruments and possibly a device for homogenizing effluents before their treatment are arranged at a bottom end of the lower part of the string. The measuring assembly is connected with the surface installation by a multiconductor cable passing from an inside of the string to the outside at the level of the side-entry sub. The pumping assembly is positioned in a well zone accessible to the produced effluents but far enough from the most deflected and/or the narrowest well portions, in order to facilitate the setting of the pumping assembly and to avoid any risk of jamming or crushing of the cable connected with the assembly of the measuring instruments.

6 Claims, 3 Drawing Sheets

DEVICE FOR ACTIVATING AND MEASURING NONFLOWING PRODUCING WELLS

BACKGROUND OF THE INVENTION

The present invention relates to an improved device for activating and measuring a nonflowing producing well and notably a deflected well, this term standing for any well at least part of which shows a more or less strong inclination in relation to the vertical and/or substantially horizontal parts.

Different procedures of an activating and logging device for wells equipped for production, of the nonflowing type, and notably for deflected wells, are described in French patent applications 2,637,939 and EN. 89/04,225. The described devices are particularly suited to wells equipped for producing oil effluents. They allow determination of the most favorable well portions when the wells cross heterogeneous reservoirs producing oil, but also water and gas. The equipment of a well generally comprises a casing that is kept in position by cementing. A liner perforated at least on part of the length thereof which continues the casing is arranged in the total zone intended for production. This perforated liner can be possibly cemented, the cemented annulus being provided with passageways which link the producing zone with the liner. A flow string built up by connecting successive sections is lowered into the liner. The flow string is provided with parts for centering the string with respect to the liner Sealing means are arranged in the annular space between the string and the liner in order to canalize in the string the total effluents produced by the producing zone. The well being nonflowing, activating or pumping means are associated with the string and lowered into the well to draw the effluents. These activating means comprise, for example, a pump rotatably driven by an electric or hydraulic motor.

The device comprises at least one assembly of measuring instruments at the base of the flow string to measure the characteristics or properties of a portion of the fluids drawn by the pump. Isolating means are arranged around the string in order to separate the liner into two parts and to limit the measurements carried out to the effluents coming from only one of these two parts. The device can also comprise two measuring assemblies to separately measure the characteristics or properties of the fluids coming from the two opposite parts of the liner. The logging device is displaced by lengthening or shortening the string in order to carry out measurements on the effluents flowing out of the formation in various locations of the well.

French patent application EN. 90/03,305 describes an improved logging device for more precisely determining the features of the multiphase flows from a producing well, with the improvement being essentially due to the use of means for homogenizing the effluents prior to treatment by the measuring instruments.

In all the patent applications cited above, the activating pump and the driving motor thereof are arranged at the base of the string at a position near the measuring instrument assemblies. It has been experienced that this layout was not suitable for many producing wells. The section of the activating pumps and of the driving motors which are commonly used is actually relatively large and, in certain cases, the previous activating and measuring devices could not be lowered into certain producing wells whose section is smaller than the standard sections. Additionally, supplying the downhole motors is carried out through electric cables most often arranged in the annular space between the liner and the flow string. In the deflected parts of the producing wells, experience has shown that this supplying mode may show some failures due to a possible crushing of the feeder cables.

SUMMARY OF THE INVENTION

The improved device according to the invention allows, by avoiding the above-mentioned drawbacks, to carry out production logs in a nonflowing well crossing a subterranean zone producing effluents, with the well being equipped for producing these effluents by a liner perforated in the part thereof going through the subterranean zone. A flow string is connected with a surface installation, with means for closing an annular space between the liner and the flow string being provided for isolating the two parts of the liner on either side. Pumping means activate the production of the well through the string, and means are provided for measuring at least part of the produced effluents, with the measuring means being arranged close to the lower end of the string.

In accordance with advantageous features of the present invention, a device is provided which includes a pumping means inserted in the flow string at a depth accessible to the effluents, a side-entry sub inserted on a portion of the string located at a position between the pumping means and the measuring means, and a multiconductor cable entering the string at a level of the side-entry sub for linking the measuring means to the surface installation.

In deflected producing wells and notably in wells crossing a producing zone with a relatively low inclination in relation to the horizontal, the length of the string portion between the location of the pumping means and the lower end of the string can be considerable. Since this string portion is generally located in the most horizontal part of the well, it is possible, in all the cases where the motor means driving the pumping means are electric motors, to avoid the setting of feeder cable lengths which are most likely to be jammed or crushed between the liner and the string.

The pumping means comprise, for example, a pump driven by an electric motor connected with the surface installation by an electric cable running outside the string.

The measuring means comprise, for example, a first assembly of instruments arranged on the string to measure the features of the effluents coming from the upstream part of the liner, which is the furthest from the pumping means.

The measuring means can also comprise a second assembly of instruments to measure the features of the effluents coming from the downstream part of the liner which is the closest to the pumping means.

The device can also comprise means for homogenizing at least part of the effluents produced before their treatment by the measuring means.

The multiconductor cable can be provided with a means for electrically connecting the measuring means, which can be plugged in a liquid medium and which is adapted to be displaced by a current of fluid along the flow string.

BRIEF DESCRIPTION OF THE DRAWINGS

Other features and advantages of the device according to the invention will be clear from reading the description hereafter of two embodiment procedures given by way of non limitative examples, with reference to the accompanying drawings in which.

DESCRIPTION OF THE PREFERRED EMBODIMENTS

Figure 1:
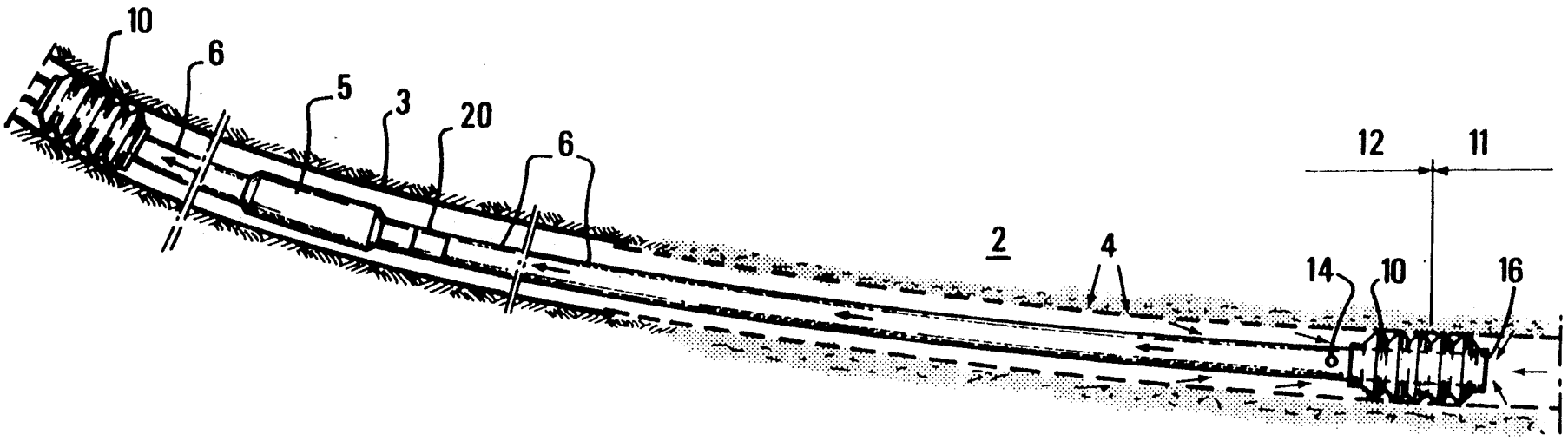
FIG. 1 in a schematic view of the device according to the invention positioned in a well portion.
Figure 2:
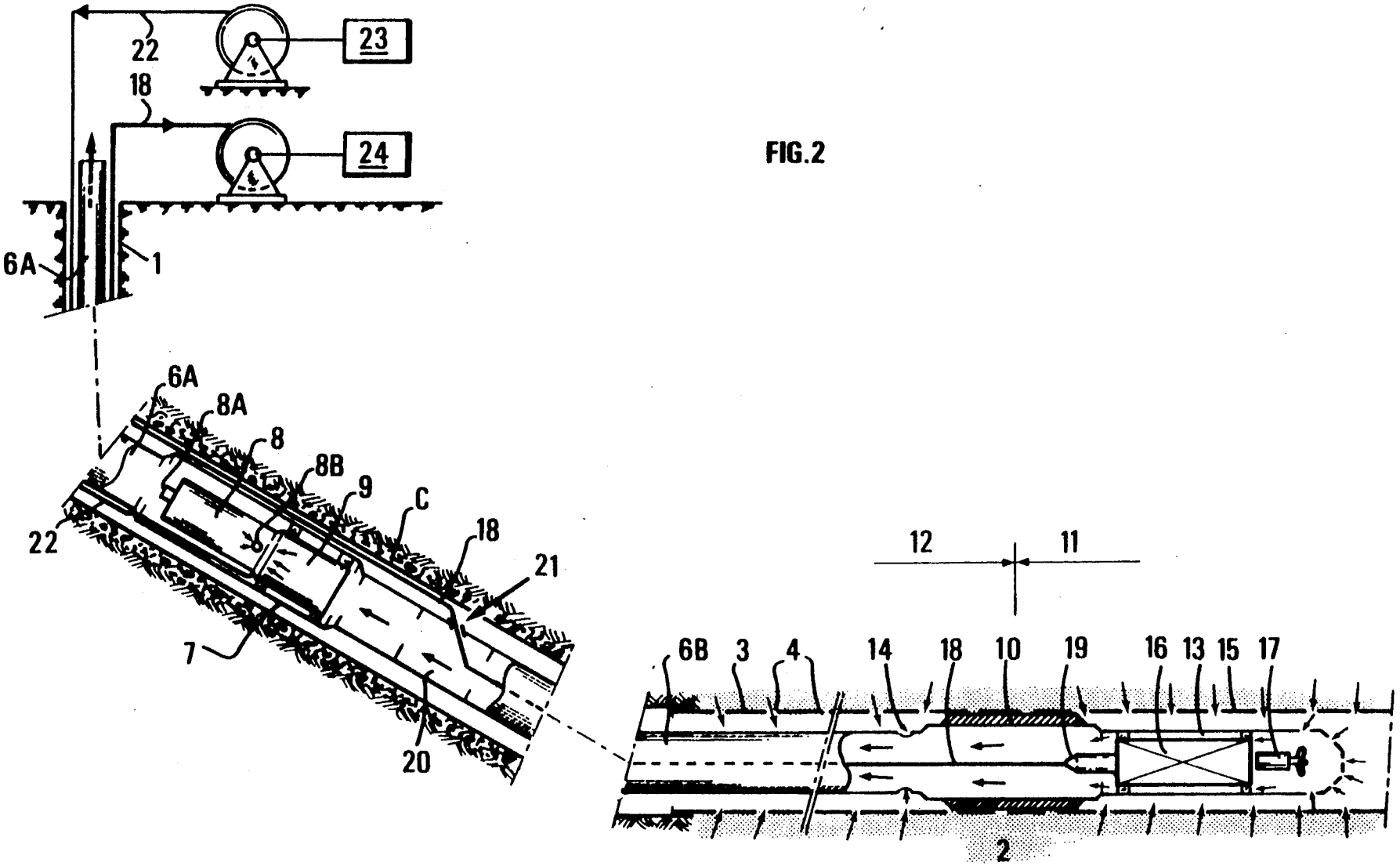
FIG. 2 is a schematic view of a first embodiment of the device according to the invention comprising only one assembly of measuring instruments for measuring the upstream effluents and a connecting system protecting the linking cables.
Figure 3:
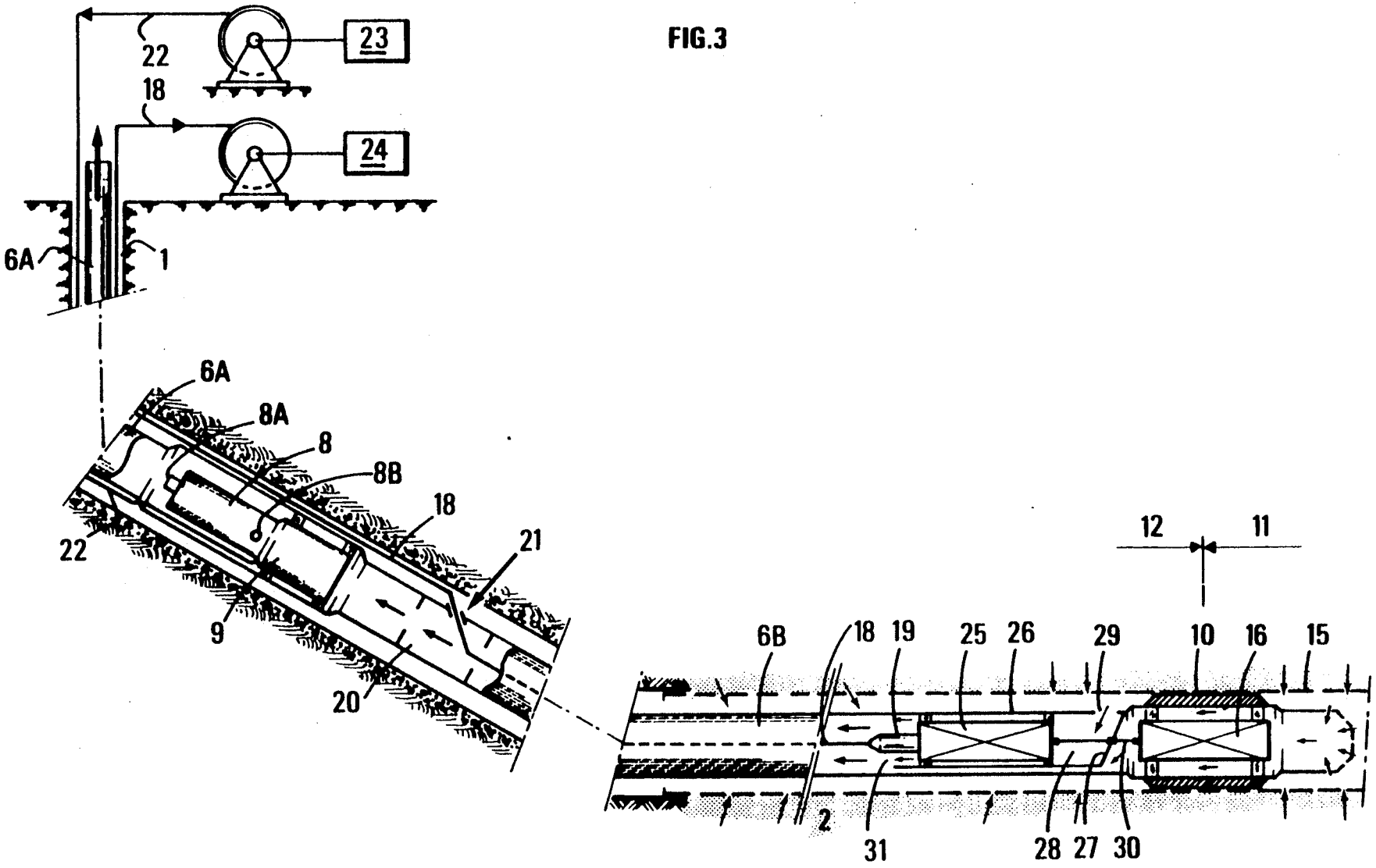
FIG. 3 is a schematic view of a second embodiment of the device comprising two assemblies of measuring instruments for measuring the upstream and downstream effluents separately, and a similar connecting system.

The well 1 shown in FIGS. 1 to 3 is drilled from a surface installation down to an oil formation 2. It is deflected in the lower part thereof crossing the producing zone. It can, for example, be horizontal or slightly inclined in relation to the horizontal. The well is equipped for production. A liner 3 is arranged to this effect in this lower part, with the liner 3 being provided with perforations 4 in the part thereof extending through the producing zone. It is a nonflowing well whose production must be activated by a pumping or suction system 5 lowered into the well inserted on a part 6A of a flow string 6 built up by juxtaposing tubular elements. The suction system 5 comprises a chamber or a housing 7 where a hydraulic pump 8 whose outlet 8A communicates with the part 6A of the string is arranged. The pump 8 is driven by an electric motor 9 which is also arranged in the chamber 7.

The upper part 6A of string 6, with the pumping system 5 fixed to the base thereof, comprises a lower extension 6B. A packer 10, for example, a inflatable or a cup type, packer or the like, is arranged around the extension 6B close to the lower end thereof. When ordered from the surface installation, a inflatable packer can be applied against the wall of liner 3 in order to separate in a substantially tight way the portions 11, 12 of the well which are located on either side. In reference to the privileged direction of flow of the effluents towards the surface, what is called the upstream zone 11 is the zone which is the furthest from the mouth of the well and what is called the downstream zone 12 is the opposite zone on the other side in relation to packer 10. Centering means (not shown) are arranged around the flow string 6 to facilitate the progress thereof in the well. The lower opening 13 of extension 6B opens on the side of the upstream well portion 11. Lateral openings 14 in the wall of this extension 6B, on the side opposite packer 10, connect the flow string 6 with the downstream part 12 of the well. The effluents entering the string 6B through the openings 13 and 14 flow towards the inlet 8B of the pump 8.

The measurings being only performed on the effluents of the upstream part in this embodiment, the openings 14 can be made anywhere between the packer 10 and the pumping system, particularly in close proximity to the pumping system.

According to the embodiment of FIG. 2, the end part 15 of the flow string contains a measuring assembly 16 comprising different instruments for measuring the upstream flows.

A first instrument is, for example, a tracer-injector for enabling a measuring of the rate of flow of the effluents coming from upstream. A second instrument is a density measuring apparatus such as a gamma densimeter. A third instrument is an electric capacitance meter for enabling a determination of, for example, the water content of the effluents.

As in the above cited French patent application EN. 90/03,305, a homogenization means 17, for example, a propeller or a turbine, can be combined with the measuring assembly to mix the different phases of the effluents from the formation, in order to obtain measurements that can be interpreted more easily and also to facilitate the locating of the well zones which are interesting for production.

The measuring assembly 16 is connected with a multiconductor cable 18 by an electric connector 19. An electric connector which can be connected in a liquid medium, combined with a load bar, which allows to set up connections deferred in time between the measuring assembly 16 and the cable 18, and to facilitate the setting of the device as shown in the description of the operation thereof, is preferably used. A connector of the aforementioned type is disclosed, for example, in French Patent 2,544,013 or in U.S. Pat. No. 4,690,214. In case a homogenization means such as 17, combined with motor means, is used, power can be supplied by conductors of the multiconductor cable 18.

The multiconductor cable 18 runs along the portion 6B of the flow string 6 until the opposite end thereof is near the pumping system 6. A side-entry sub 20 is preferably inserted between the housing 7 containing the pumping system 5 and the string portion 6B. The multiconductor cable 18 runs along the entry 21 of sub 20 and runs up towards the surface installation outside the upper part 6A of the string.

The electric motor 9 driving the pump 8 is supplied by a cable 22 which also runs up towards the surface installation in the annulus between the casing C cemented in the well and the upper part 6A of the string.

The motor 9 of the pump is, for example, an asynchronous motor and the feeder cable 22 connects it with a frequency converter 23 adapted for delivering an electric current to the asynchronous motor 9 with an adjustable frequency so as to enable a varying of the output of pump 8 in dependence upon the amount of effluents produced. The multiconductor cable 18 connects the measuring instruments of assembly 16 with a control, acquisition and supply assembly 24 arranged at the surface. The multiconductor cable 18 comprises conductors for the electric supply of the measuring instruments of the measuring assembly 16 and, possibly, the motor driving the homogenization means, as well as other conductors for transmitting to the assembly 24 the signals provided by the measuring instruments.

The above described construction enables avoiding many difficulties which may arise in the most deflected part of the well and also often in the narrowest part thereof. The pumping assembly 5 is lowered to a sufficient depth at which the produced effluents can freely be reached, without any activation. Since this depth varies according to the position of the measuring assembly 16, the pumping assembly is often lowered into a less deflected well portion which is more easily accessible. The multiconductor cable 18 is protected by the flow string in the total lower portion of the well. Like feeder cable 22 of motor 9, the cable 18 is located in the annulus around the flow string only in the upper part of the well where it is less exposed to jammings and crushing.

In the embodiment of FIG. 3, the device according to the invention also comprises a second measuring assembly 25 for the effluents coming from the downstream zone 12. To that effect, the liner portion 15 beyond the packer 10, which contains the first measuring assembly 16 for the upstream effluents, is connected and communicates with a second string portion 26 provided with an inner partitioning 27 which delimits a compartment 28. An opening 29 connects compartment 28 with the downstream part 12 of the well. Another homogenization means (not shown) can also be arranged within the compartment 28 to mix the downstream effluents before their treatment by the second measuring assembly 25. In this case, it is the second measuring assembly 25 which is connected with the multiconductor cable 18 through the electric connector 19. The power supply of the measuring devices of the first measuring assembly 16 and the transferring of the measuring signals between the latter and the second measuring assembly 25 is provided by a multiconductor cable 30 crossing partition 27.

The compartment 28 communicates through an opening 31 with the part 6B of the flow string. The measured upstream flow diverted by partition 27 and the measured downstream flow coming out of opening 31 go back up the string portion 6B to the inlet 8B of the pump.

In its upper part, the flow string 6 may comprise a bypass line on which a third measuring assembly (not shown) is arranged to treat the total effluents reaching the surface. This third measuring assembly 30 can be similar to the previous measuring assemblies 16, 25. It can also be an apparatus of the test separator type which separates the phases before measuring them separately and which is located at the surface outside the well.

The device according to the invention enables measurements in different places of the producing well, be it flow rates of the upstream zone, that is, the embodiment of FIG. 1 and/or of the downstream zone, that is, the embodiment of FIG. 2. By comparing the measurings performed with the different measuring instruments of each assembly 16 and/or of the third measuring assembly at the surface on the effluents after their possible homogenization, the share of each phase in the suctioned triphasic mixtures can be easily determined.

Comparing the measurings performed by the two assemblies 16, 25 with those performed by the third assembly treating the total effluents, adjusted to take into account the conditions prevailing at the surface, different from those prevailing in the producing zone enables a validation of the results by drawing up balances.

The setting of the device in the producing zone is carried out as follows:

The pipe portion 15 containing the first measuring assembly 16 (FIG. 2), or possibly the total two pipe portions 15 and 26 respectively containing the two measuring assemblies 16 and 25 (FIG. 3), is connected with pipe sections, and the lower part 6B of the flow string is formed successive lengthenings.

After cable 18 and the connector 19 thereof have been passed into the string through the entry of the side-entry sub (SES) 21, the side-entry sub 21 is fastened. The electric connector 19 is lowered by gravity or by pumping along string 6B until the connector 19 plugs in at the level of the measuring assemblies 16 and/or 25.

The housing 7 containing the pump is fastened. The fastening is preferably achieved with a sub fitted with a rotating nut and an angular positioning key of a well-known type which enables the formation of a mechanical connection without having to rotate the sub 21 and the housing 7 relative to one another.

The two cables 18 and 22 being outside, the measuring assembly 16 and/or 25 is advanced by lengthening the string 6A by successively adding sections, down to the well zone where the measurements are to be carried out.

With a device constructed in the manner described hereinbelow, the measuring assemblies are displaced in the well along the producing zone by successively adding or withdrawing pipe sections and, by comparing the measurements performed in these different places, the composition of the effluents and the variation of their flow rate can be determined according to the position in the well. It is advisable to ensure that the pump is maintained in a position ranging between the dynamic level and a depth compatible with the allowable maximum inclination.

We claim:

1. A device for activating a non-flowing well traversing a subterranean zone containing effluents and for measuring effluents produced by an activation of the device, the well including a liner perforated at least in a portion thereof extending through said subterranean zone, the device comprising:

a flow string connected with a surface installation, said flow string having a diameter less than a diameter of the liner so as to define an annular space between the liner and the flow string;

means for closing the annular space to divide the liner into an upstream part and a downstream part on respective sides of the means for closing, said upstream part and said downstream part being isolated from each other by said means for closing;

means for measuring at least a portion of the produced effluents;

means for activating the production of the well including pumping means inserted in the flow string at a depth accessible to the effluents;

a side entry sub inserted in a portion of the string at a position between the pumping means and said means for measuring; and a multiconductor cable associated with connecting means entering the flow string at the level of said side-entry sub for connecting the means for measuring to the surface installation.

2. A device as claimed in claim 1, wherein the pumping means comprises a pump driven by an electric motor connected with the surface installation through an electric cable running outside said flow stream.

3. A device as claimed in one of claims 1 or 2, wherein the measuring means comprise a first assembly of instruments arranged on said flow string for measuring characteristics of the effluents coming from the upstream part of the liner, said upstream part being disposed at a position furtherest from the pumping means.

4. A device as claimed in claim 3, wherein the measuring means further comprise a second assembly of instruments for measuring characteristics of the effluents coming from the downstream part of said liner, said downstream part being disposed at a position closest to the pumping means.

5. A device as claimed in one of claims 1 or 2, further comprising means for homogenizing at least part of the effluents prior to measurement by the measuring means.

6. A device as claimed in one of claims 1 or 2, wherein the multiconductor cable includes means for electrically connecting the cable to the measuring means, said means for electrically connecting being adapted to be connected in a liquid medium, and wherein said means for electrically connecting is adapted to be displaced by a flow of fluid along the flow string.

* * * * *